US005823026A

United States Patent [19]

Finke

[11] Patent Number: 5,823,026

[45] Date of Patent: Oct. 20, 1998

[54] LOCKING DEVICE FOR A DOOR

[75] Inventor: Andreas Finke, Gevelsberg, Germany

[73] Assignee: DORMA GmbH + Co. KG, Ennepetal, Germany

[21] Appl. No.: 725,744

[22] Filed: Oct. 4, 1996

[30] Foreign Application Priority Data

Jan. 19, 1995 [DE] Germany ..... 195 01 420.0

[51] Int. Cl.[6] ..... E05B 47/00

[52] U.S. Cl. ..... 70/276; 70/279; 292/144; 292/251.5

[58] Field of Search ..... 292/144, 201, 292/251.5; 70/276–282, 413

[56] References Cited

U.S. PATENT DOCUMENTS

| | | | |
|---|---|---|---|
| 2,219,186 | 10/1940 | Hornfeck | 292/251.5 X |
| 2,894,778 | 7/1959 | Lundholm | 292/251.5 |
| 2,947,560 | 8/1960 | Klee | 292/251.5 X |
| 2,950,139 | 8/1960 | Carbary | 292/251.5 |
| 2,956,828 | 10/1960 | Clark | 292/251.5 |
| 3,790,197 | 2/1974 | Parker | 292/251.5 |
| 3,837,193 | 9/1974 | Csurgay | 70/276 |
| 4,677,834 | 7/1987 | Hicks | 70/279 |
| 4,807,455 | 2/1989 | Mauer | 70/279 X |
| 5,029,912 | 7/1991 | Gotanda | 292/144 X |
| 5,188,405 | 2/1993 | Maccaferri | 70/413 X |
| 5,362,116 | 11/1994 | Doyle et al. | 292/144 |
| 5,377,513 | 1/1995 | Miyamoto et al. | 70/276 |
| 5,485,733 | 1/1996 | Hoffman | 70/276 |

FOREIGN PATENT DOCUMENTS

| | | | |
|---|---|---|---|
| 0394157 | 10/1990 | European Pat. Off. . | |
| 429712 | 6/1991 | European Pat. Off. | 70/276 |
| 2057899 | 5/1971 | France . | |
| 145325 | 11/1903 | Germany | 70/276 |
| 2515161 | 10/1976 | Germany . | |
| 3209751 | 9/1983 | Germany | 70/276 |
| 3327582 | 4/1985 | Germany . | |
| 1189981 | 11/1985 | U.S.S.R. | 70/276 |
| 2131869 | 6/1984 | United Kingdom . | |
| 2279991 | 1/1995 | United Kingdom . | |

*Primary Examiner*—Suzanne Dino Barrett
*Attorney, Agent, or Firm*—Nils H. Ljungman and Associates

[57] ABSTRACT

An electromechanical locking mechanism which can execute a pulse-control for the locking or unlocking of door panels. A bistable electromagnet interacts with an appropriately shaped lever so that a permanent magnet which is fastened to the lever arm and a permanent magnet which is fastened to a mounting plate repel one another and can thereby move the lever into a secure position, namely into a locked or unlocked position.

18 Claims, 5 Drawing Sheets

LOCKING DEVICE FOR A DOOR

This application is a continuation-in-part application of International Application No. PCT/DE95/01140, filed on Aug. 26, 1995, which claims priority from Federal Republic of Germany Application No. DE-P 195 01 420.0, filed on Jan. 19, 1995. International Application No. PCT/DE95/01140 designated the U.S. as a designated state.

BACKGROUND OF THE INVENTION

1. Field of the Invention

The present invention relates to a locking device (or catch, or latching mechanism) for doors, whereby the doors in question are preferably sliding doors. These doors can be actuated, for example, manually, hydraulically or electromechanically. It is irrelevant how the door, which has at least one moving door panel, is moved from the open position into the closed position and from the closed position into the open position. It is of particular importance, however, that such doors can also be appropriately secured in the closed position, i.e., so that the door cannot be opened unintentionally. As a result of the use of a locking mechanism, it is possible to securely close the moving door panel without the need for an additional lock. The category of doors on which the present invention can be used includes, for example, elevator doors, in addition to the exterior sliding doors of a building.

2. Background Information

Similar locking devices include purely mechanical locking devices as well as electromechanical locking devices. When electromechanical locking devices are used, for example, like those described in the DORMA GmbH +Co. KG Technical Data Sheet for Automatic Sliding Door Drive Systems ES 55/60, the locking devices in question are installed in a door frame, and in connection with an electromagnet a locking bolt is extended and engaged in the moving panels, thereby locking them to one another.

GB 2,279,991 A describes a locking device which has an electromagnet. The electromagnet thereby actuates a lever which is mounted on one side, on which lever two permanent magnets are fastened, and to which a rotationally mounted bolt is also attached. When an additional electromagnet is energized, the lever is thereby held in its locked and unlocked position.

German Patent No. 25 15 161 B2 describes a controllable sliding bolt (e.g., a dead bolt) of a lock, which sliding bolt is held in the open and closed position by magnets. The sliding bolt is moved into its respective locked or unlocked position by means of a pulse-controlled electromagnet. The sliding bolt is then held in this position by permanent magnets.

OBJECT OF THE INVENTION

One object of the present invention is the provision of a locking mechanism which can be used on doors of any type of construction, in particular, a locking mechanism which can be manufactured economically and contains a relatively small number of components. The result is a locking device which does not require maintenance and meets all the installation criteria in terms of safety and security and can be installed under any conditions.

SUMMARY OF THE INVENTION

The invention teaches that this object can be accomplished by creating a locking mechanism which has an electromagnet which is preferably equipped with two windings which can be actuated separately. The electromagnet performs only a supporting function, because the locking mechanism is constructed so that the electromagnet need only be energized by brief current pulses to one of the windings to move it into a safe switching position, both in the open position and in the closed position. The electromagnet is thereby significantly smaller, in terms of its performance data, than the electromagnet which is conventionally used in such applications. The armature of the electromagnet can be equipped with a fork head, in which an arm which points away from a lever is mounted rotationally. As a result of the movement of the armature, this positive connection makes possible short strokes which in turn act on the lever such that the locking mechanism can be unlocked and locked as a function of the position of the armature, i.e., whether it is retracted or extended. The lever is mounted in a pivot and is counterbalanced by its weight without any connection to the fork head. Next to (e.g., on either side of) the arm which points away, starting from the pivot point with its pivot, there is an additional arm on each side. These arms can be different in terms of their geometric dimensions, because, for example, the locking hook for locking and the locking bolt can simultaneously be on one longer arm.

Starting from the pivot bearing, toward the opposite side, there is a second, shorter arm which is equipped with a counterweight. This counterweight makes it possible to hold the lever in the balance, i.e., when the fork head of the armature is not connected, the lever is counterbalanced by the electromagnet. As a result of its configuration, the electromagnet can need to execute only a very short stroke, whereby at the same time the arm with the locking hook executes a significantly shorter stroke, and thus reliably releases the locking bolt or engages with it.

In one embodiment of the invention, it is also possible to realize the pivoting lever so that the arms on each side are each provided with a locking hook. Such a lock can, for example, be installed permanently on or in a door frame or casing, in which case the locking hooks of a two-panel door are always fastened to the moving panels. Such a locking mechanism is also provided with a small electromagnet which preferably has two separate windings.

In addition to the automatic locking mechanism, a manual unlocking mechanism can also be integrated which is operated by manually pivoting the lever by means of the actuation of a device which can be triggered by means of a linkage or cable.

A permanent magnet is also preferably fastened to at least one of the arms of the lever of the locking mechanism, which permanent magnet interacts with an additional permanent magnet which is mounted in a stationary fashion on a mounting plate. The poles of the permanent magnets are arranged so that the like poles are always opposite one another. As a result of this arrangement of the poles, there is a repulsion between the permanent magnets, and thus the lever is automatically pressed and held either in the locking position or in the unlocking position. This movement can occur without the presence of additional spring elements in the form of tension or compression springs, which of course achieve a very exact positioning, but also require a higher energy consumption for the electromagnets. Alternatively it would be possible to attach a leaf spring so that only two stable lever positions are possible, although this type of construction also has the disadvantage that it requires more energy and is more expensive.

As a result of the construction claimed by the invention, the electromagnet only needs to execute a short stroke, and as a result of the magnetic force exerted by the permanent magnets, the lever is pushed into both the locking position and into the unlocking position and held there. As a result of the use of an electromagnet which has two separate windings, all that is required is a brief current pulse applied to one of the two windings. On one hand, this requirement for only a brief current pulse has the effect of reducing the amount of electricity required, and on the other hand, with the type of device described above, the electromagnet can be sized significantly smaller and can be manufactured more economically. Consequently, the two permanent magnets hold the lever securely in the desired position.

In order to be able to determine the position precisely, there is also an indicator on the locking mechanism, which indicator preferably interacts with the lever. As a result of this measure, the control system is reliably informed of which switching position the locking hook or hooks have assumed. For example, the indicator can be a switch or any other appropriate device which is fastened to the mounting plate.

The electromagnet and the pivot for the lever can also be fastened simultaneously to the mounting plate. A locking mechanism of the type mentioned above, which is moved into the locked position or out of the unlocked position by only brief current pulses, can thus be attached to any type of door, and is also suitable for locking and unlocking by remote control, which means that it is no longer necessary to install a separate lock on such doors.

In summary, one aspect of the invention resides broadly in a locking mechanism for a door, the door being at least one of a hydraulic, an electromechanical and a manually operated door, the locking mechanism being for the securing of two door members in at least one of a locked and an unlocked position, the locking mechanism comprising: a locking lever member, the locking lever member being movable between at least two lever positions, the locking lever member substantially restraining relative movement between the two door members in a first of the at least two lever positions, and the locking lever member substantially permitting relative movement between the two door members in a second of the at least two lever positions, electromagnetic means for moving the locking lever member between the first lever position and the second lever position, first magnetic means disposed on the locking lever member, the first magnetic means moving with the locking lever member between the first lever position and the second lever position, and second magnetic means, the second magnetic means being stationarily mounted, and the first magnetic means and the second magnetic means exerting magnetic forces on one another to substantially maintain the locking lever member in at least one of the first and second lever positions.

Another aspect is a locking mechanism for a door, the locking mechanism being for the securing of two door members in at least one of a locked and an unlocked position, the locking mechanism comprising: a locking lever member, the locking lever member being movable between at least two lever positions, the locking lever substantially restraining relative movement between the two door members in a first of the at least two lever positions, and the locking lever substantially permitting relative movement between the two door members in a second of the at least two lever positions, electromagnetic means for moving the locking lever member between the first lever position and the second lever position, first magnetic means disposed on said locking lever member, the first magnetic means moving with the locking lever member between the first lever position and the second lever position, and second magnetic means, the second magnetic means being stationarily mounted, and the first magnetic means and the second magnetic means exerting magnetic forces on one another to substantially maintain the locking lever member in at least one of the first and second lever positions.

The above discussed embodiments of the present invention will be described further hereinbelow with reference to the accompanying figures. When the word "invention" is used in this specification, the word "invention" includes "inventions", that is, the plural of "invention". By stating "invention", the Applicant(s) does/do not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to two possible embodiments which are illustrated schematically in the accompanying drawings.

DESCRIPTION OF THE PREFERRED EMBODIMENT

Figure 1:
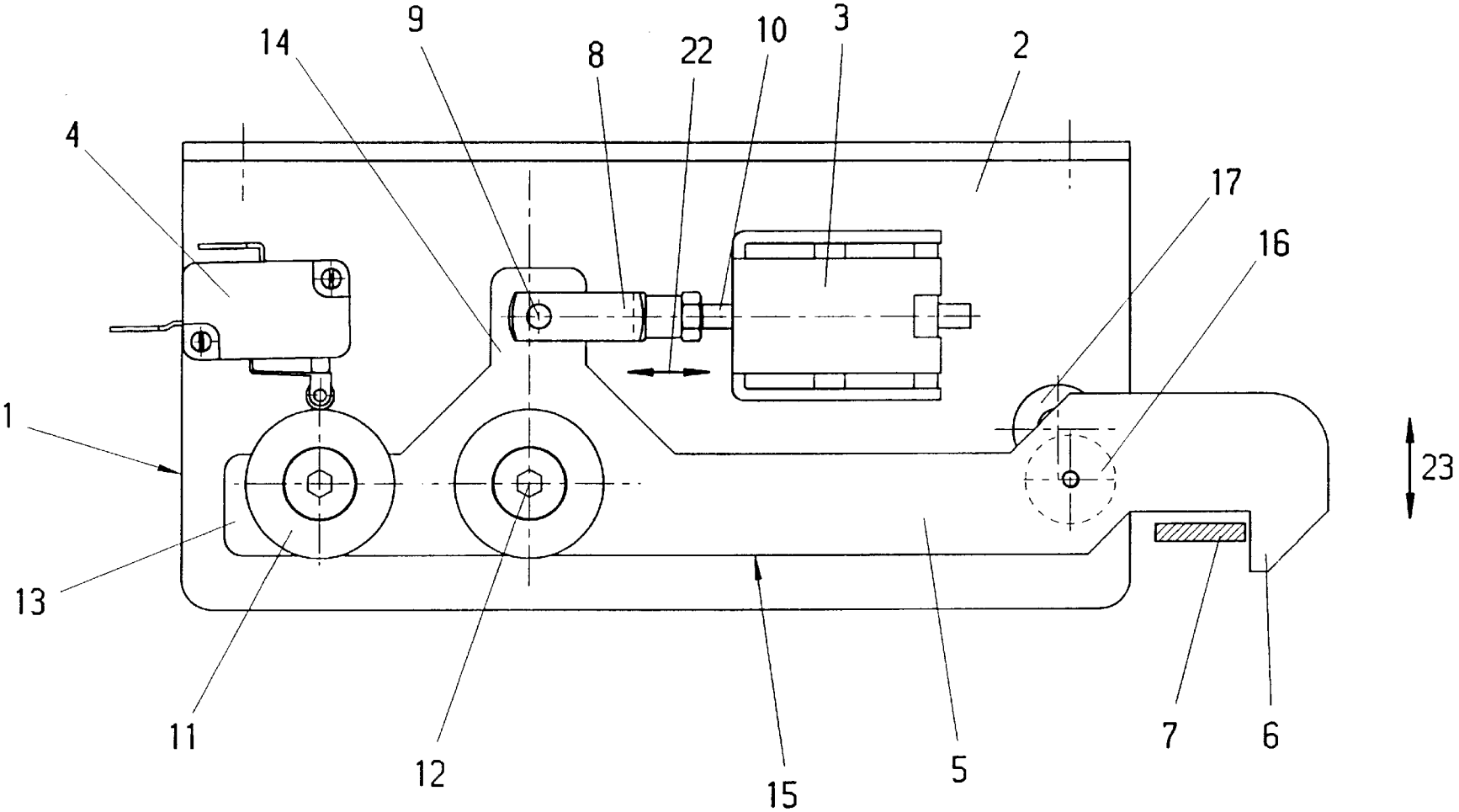
FIG. 1 is an elevational view of a locking mechanism constructed according to the invention.
Figure 2:
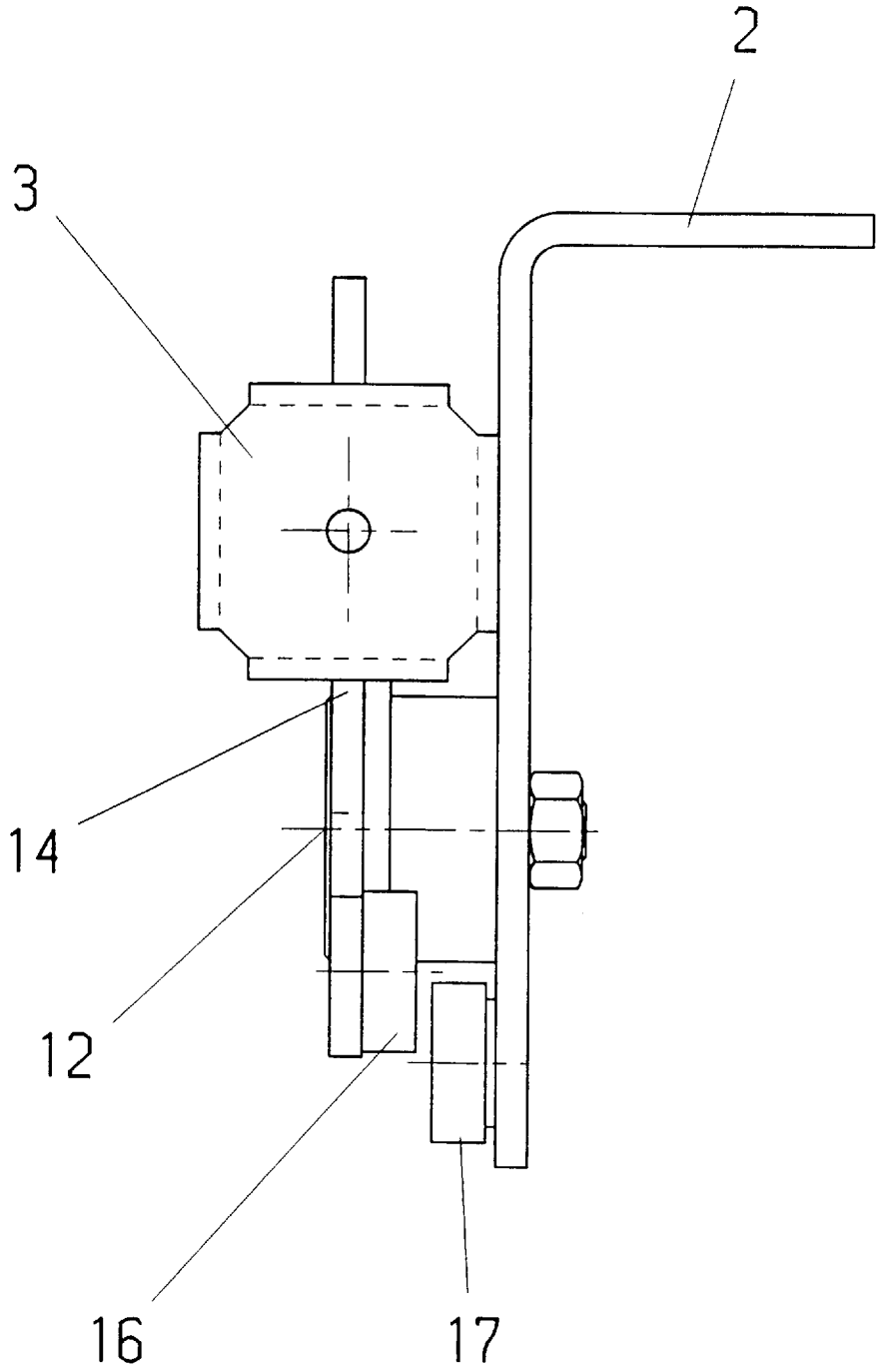
FIG. 2 is a side view of a locking mechanism as illustrated in FIG. 1.
Figure 3:
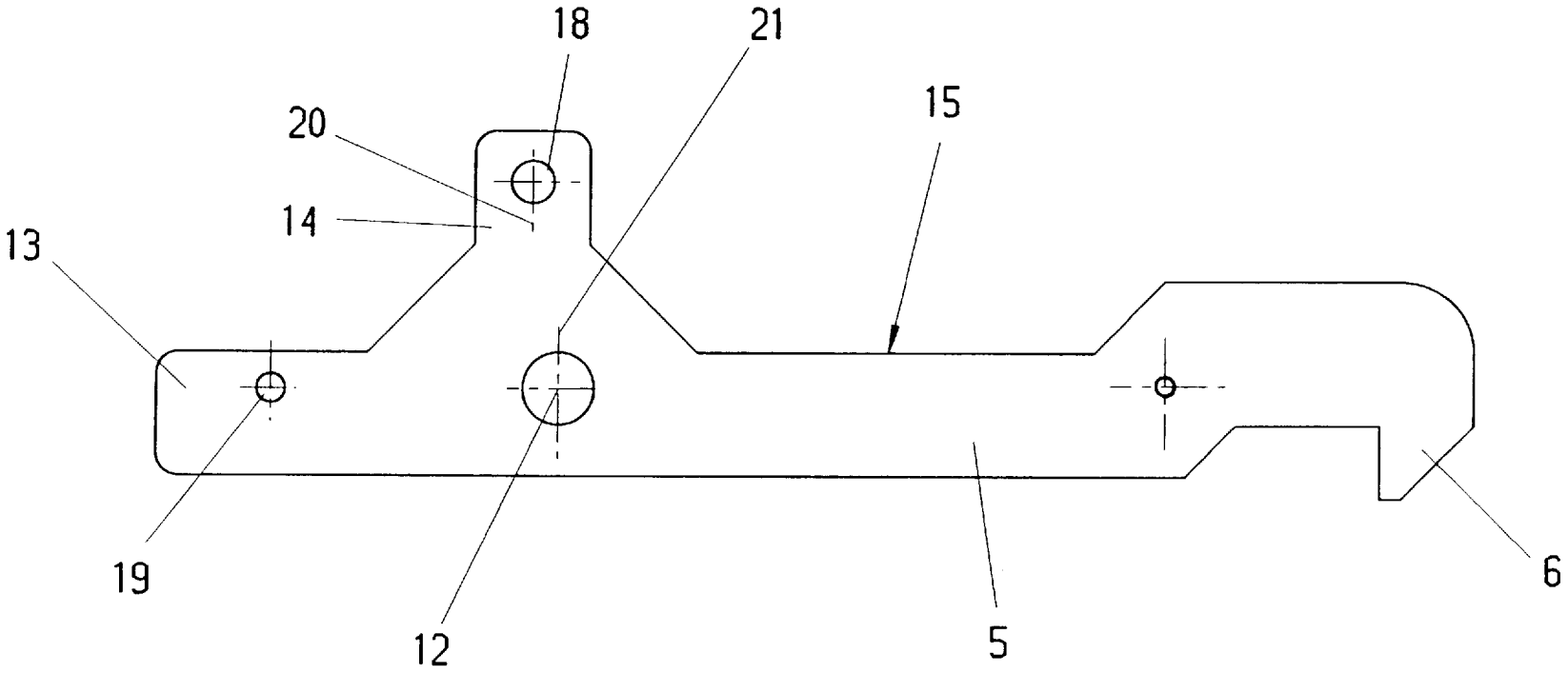
FIG. 3 is an elevational view of the lever installed in the locking mechanism illustrated in FIGS. 1 and 2.

The embodiment of a locking mechanism illustrated in FIGS. 1 and 2 is installed on a mounting plate 2. The locking mechanism 1 consists essentially of a lever 15 with an electromagnet 3 attached to it and an indicator, e.g., in the form of a switch 4, which reports the position of the lock hook 6, namely, whether it is in the locked or unlocked position. The lever 15, which is also illustrated in isolation in FIG. 3, consists essentially of a long lever which is mounted in a pivot 12. This pivot 12 is preferably not located in the center of the lever 15, but away from the center. Considered in this manner, the lever 15 therefore extends from the pivot 12 on one side into an arm 5, and on the other side into an arm 13. The arm 5 is preferably longer in terms of its geometric dimensions than the arm 13. The locking hook 6 is also located on the arm 5. In the arm 13 there is a hole 19 (FIG. 3), by means of which a counterweight 11 is positively and non-positively connected to the arm 13. This counterweight 11 is sized so that when the lever 15 is mounted in the pivot, a counterbalancing of the two arms 5 and 13 can be accomplished without connecting the electromagnet 3 (that is, when the electromagnet 3 is not connected).

In addition to the arms 5 and 13, on the side of the arm 13 there is an additional part 14 which represents a wider portion of the arm 13. As seen most clearly in FIG. 3, the placement of the arm 14 is determined so that its center axis 20 is not far away from the center axis 21 of the pivot 12. In the arm 14 there is also a hole 18 for the connection of the electromagnet 3.

An examination of the lever 15 shows that according to the lever principle, there is a large lever arm on the one side, namely, on the side of the arm 5, and two short lever arms, namely on the side of the arms 13 and 14. To balance these arms over the center axis 21, a counterweight 11 is therefore provided. A lever arm 15 counterweighted in this manner is rotationally connected by means of the pivot 12 to the mounting plate 2.

By means of the connection 9, the hole 18 can locate a fork head 8 which is connected to the armature 10 of an electromagnet 3. As a result of the connection 9, which is only positive (or interlocking), a movement of the armature 10 is therefore possible in the range of the direction of movement 22. The electromagnet 3 is thereby preferably equipped with two separate windings.

On the arm 5 of the lever 15, a permanent magnet 16 can also be positively and non-positively connected to the lever 15. On the opposite side, namely on the facing side of the mounting plate 2, there is also a permanent magnet 17 which is effectively connected to the permanent magnet 16. The poles of the two permanent magnets 16 and 17 are arranged so that the magnets repel one another. As a result of the repulsion forces, the lever 15 is moved around the pivot 12 on account of the short stroke of the electromagnet 3. This movement results in the direction of movement 23 on the end of the arm 5, which on one hand performs a locking with the locking bolt 7, and on the other hand, in the unlocked position, releases the locking bolt 7. By means of a brief current pulse on one of the two windings of the electromagnet 3, the magnetic forces of the permanent magnets 16 and 17 are exerted so that the two magnets repel one another, and thus move the lever 15, which is guided by the pivot 12, to move on the trajectory 23, namely to move it into the locking or unlocking position. Since the windings of the electromagnet 3 are energized with only a brief current pulse, the locking hook 6 is held in its locked position with the locking bolt 7 only by the repelling forces of the permanent magnets 16 and 17. The same situation prevails in the unlocked position, after the lever 15 is pivoted on the trajectory 23.

In other words, the two permanent magnets 16 and 17 can be positioned such that, in either of the locked or unlocked positions of the lever 15, like poles of the two permanent magnets 16 and 17 (i.e., either the north or south poles) are aligned facing one another. As a result of this alignment, in both of the locked and unlocked positions of the lever 15, the repelling magnetic forces exerted by the like poles of the permanent magnets 16 and 17 serve to maintain the lever 15 in either of the locked or unlocked positions, absent an energization of the electromagnet 3. In this regard, the lever 15 and the permanent magnets 16 and 17 act as a bistable element, having stable positions in both the locked and unlocked positions of the lever 15. The electromagnet 3 serves to switch the bistable element through the center position of instability from one bistable position to another.

While as noted above, in one preferred embodiment, the electromagnet 3 contains two windings for energizing the lever 15, respectively, in the opposite directions of movement, it will be understood that the electromagnet could, of course, contain only one winding, together with circuitry for reversing the polarity of the energizing current to thereby selectively move the lever 15 in either of the locking and unlocking directions.

To determine the current position of the locking mechanism 1, there can be simultaneously a switch 4 which reports the status of the locking mechanism, namely whether the locking mechanism is closed or open, to the control system which is connected to the door.

A locking mechanism 1 of the type described above can therefore be manufactured economically, because on one hand an economical electromagnet 3 is used, and on the other hand the entire locking mechanism 1 can be pre-assembled. Such a pre-assembled locking mechanism 1 can be connected with its mounting plate 2 by means of a fastening, for example on a truck (or trolley, or runner) or in the upper area on a moving door panel, to which it can be connected positively and non-positively. In that case, the locking bolt 7 on the second moving panel can be in a position which makes it possible to lock the two moving door panels to one another. But it is also conceivable that a locking mechanism 1 of the type described above can be used on only single-panel doors, in which case the locking mechanism can be fastened either to the door frame itself, or the locking bolt can be fastened to a stationary point on the door frame.

Figure 4:
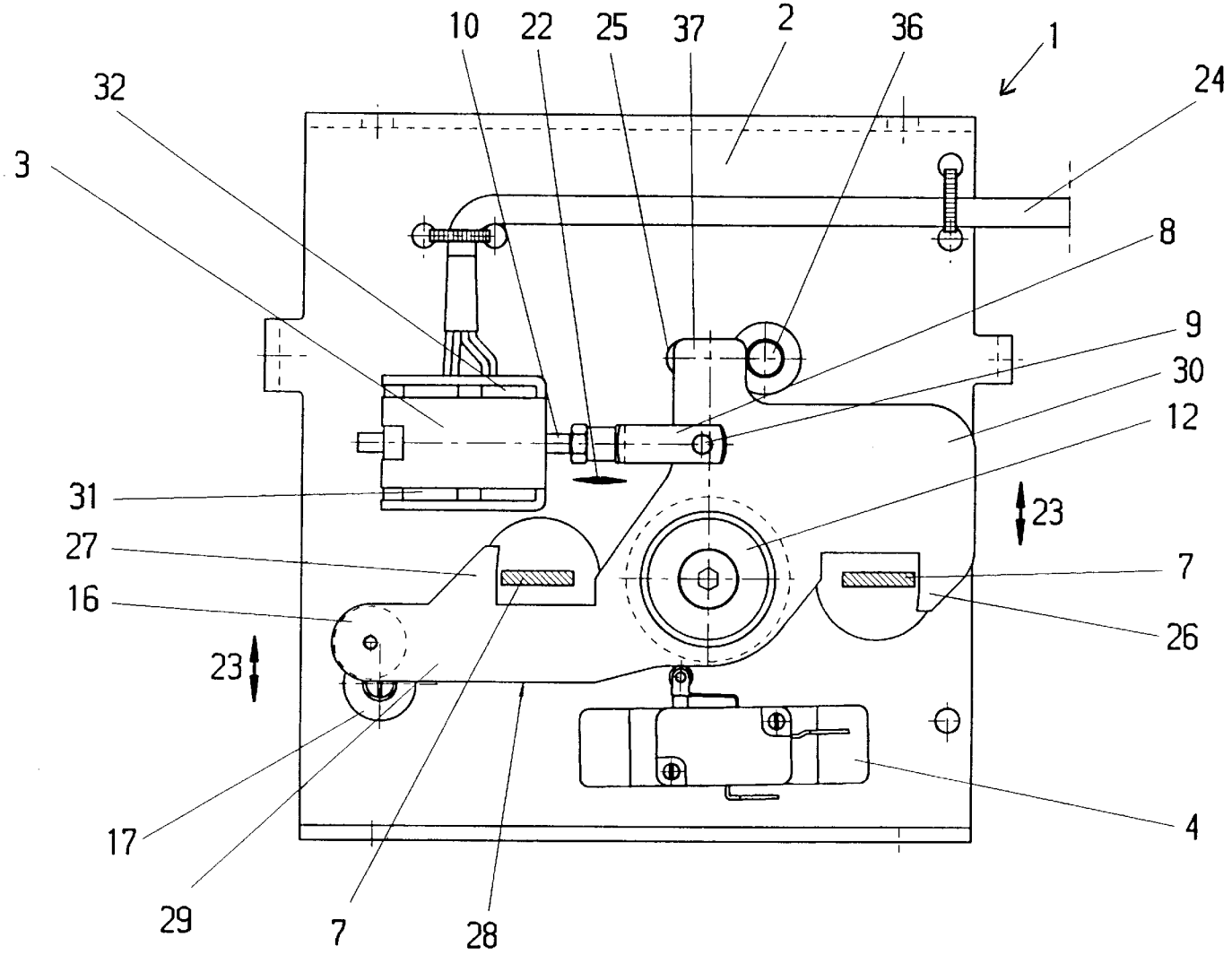
FIG. 4 is an elevational view of an alternative embodiment of the locking mechanism.
Figure 5:
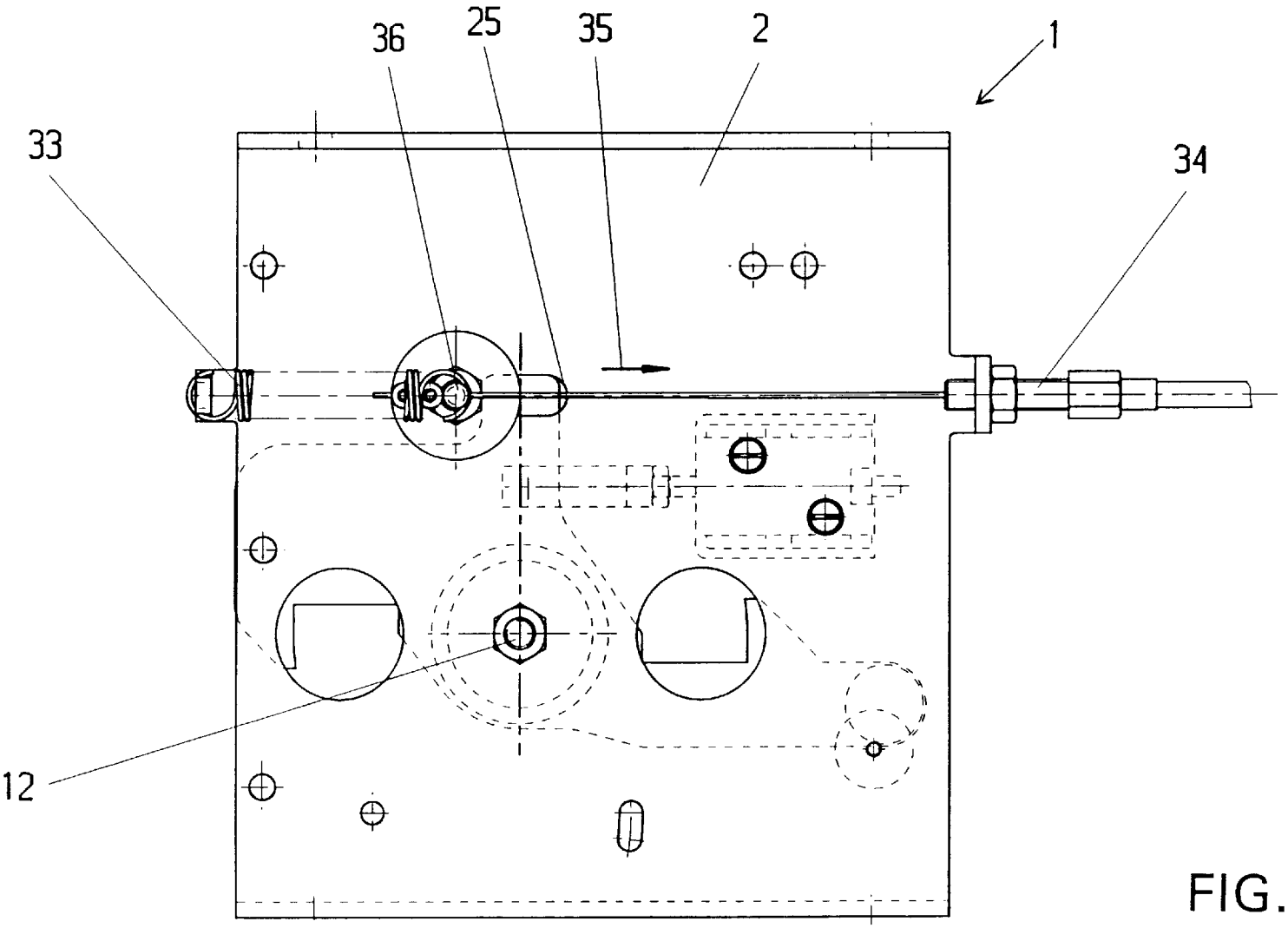
FIG. 5 is a rear elevational view of the locking mechanism illustrated in FIG. 4, showing a manual unlocking mechanism thereof in more detail.

FIGS. 4 and 5 illustrate an additional embodiment of the locking mechanism 1 in which the lever 28 is mounted with its arms 29 and 30 approximately in the center of the pivot 12. In this embodiment, too, a fork head 8 is engaged, which fork head 8 is connected by means of a positive (or interlocking) connection 9 to an armature 10 of an electromagnet 3. If this electromagnet 3, which is preferably provided with the two separate windings 31 and 32, is energized by brief pulses to each of the windings, the armature 10 is thereby displaced in the directions of movement 22 and thus the lever 28 is moved in the indicated directions 23 into a locking or unlocking position. Attached to at least one of these arms 29 or 30 of the lever 28 is a permanent magnet 16 which, as described above, also interacts in the manner described above with a permanent magnet 17 which is fastened to the mounting plate 2.

The lever 28 is provided on each of its arms 29 and 30 with a respective locking hook 26 and 27. When a two-panel door is in the closed position, these locking hooks are engaged over the locking bolts 7 and thereby hold the closed door panels in the secure locked position, in which case the entire locking mechanism 1 is attached in a stationary manner to the mounting plate 2 inside the door frame. The electromagnet 3 is energized with the corresponding control pulses for the two windings 31 and 32 by means of a cable 24.

In addition to the electromechanical type of locking mechanism described above, a manual unlocking can also be performed when necessary. This manual unlocking mechanism is designed so that an actuator bolt 36 is mounted so that it can be displaced through an opening, which actuator bolt 36 is engaged with an arm 37 of the lever 28. When a linkage is actuated, or when, as in the embodiments illustrated in FIGS. 4 and 5, a Bowden cable 34 is actuated in the direction 35, the actuator bolt 36, to which pressure is applied by a spring element 33, is pulled against the arm 37 of the lever 28. Consequently, the lever 28 is pivoted around the pivot 12, and is moved to and securely held in the unlocked position by the forces of the magnets 16 and 17.

Such a door can easily be unlocked by the manual unlocking procedure when the door control system is de-energized, for example, in a danger situation. The manual unlocking procedure can be used both on single-panel doors and on multi-panel doors. On the mounting plate 2 of the embodiment of FIGS. 4 and 5, there is also preferably provided a switch 4 which indicates the position of the locking mechanism.

In the two embodiments described above, as a result of the construction claimed by the invention, the electromagnet 3 requires only a short stroke, just enough to get past the dead-center position of the two permanent magnets 16, 17.

One feature of the invention resides broadly in the lock for hydraulically, electromechanically and manually operated doors, which locking mechanism effects a locking of moving door panels by means of the actuation of a device in connection with a locking mechanism, characterized by the fact that the device of the locking mechanism 1 consists of an electromagnet 3 which is equipped with two windings 31, 32 which can be energized separately, and there is a non-positive connection 9 between an armature 10 of the electromagnet 3 and a pivoting lever 15, 28, whereby the lever 15, 28 is preferably provided with two arms 5, 13 and 29, 30, and that a permanent magnet 16 is attached to at least one of the arms 5, 13, 29, 30, which permanent magnet 16 interacts with a stationary permanent magnet 17 such that a locking position or an unlocking position can be reliably assumed.

Another feature of the invention resides broadly in the locking mechanism characterized by the fact that the permanent magnets 16, 17 have the same polarity on the facing poles.

Yet another feature of the invention resides broadly in the locking mechanism characterized by the fact that on the armature 10, there is a fork head 8 which enters into the positive connection 9 with the arm 14.

Still another feature of the invention resides broadly in the locking mechanism characterized by the fact that the locking mechanism 1 is mounted on a mounting plate 2.

A further feature of the invention resides broadly in the locking mechanism characterized by the fact that the levers 15, 28 are counterbalanced by means of the pivot 12.

Another feature of the invention resides broadly in the locking mechanism characterized by the fact that on the levers 15, 28, there is an indicator to identify the locking position.

Yet another feature of the invention resides broadly in the locking mechanism characterized by the fact that the indicator is a switch 4.

Still another feature of the invention resides broadly in the locking mechanism characterized by the fact that on at least one of the arms 5, 13, 29, 30 there is a locking hook 6, 26, 27.

A further feature of the invention resides broadly in the locking mechanism characterized by the fact that the door can be unlocked manually, regardless of whether it is connected to the power supply, by means of an additional locking mechanism.

Another feature of the invention resides broadly in the locking mechanism characterized by the fact that the mounting plate 2 is fastened to a door panel, and the locking hook 6 interacts with a lock bolt 7 which is mounted on an additional door panel.

Yet another feature of the invention resides broadly in the locking mechanism characterized by the fact that the mounting plate 2 is fastened to a door panel and the locking hook 6 of the lock interacts with the lock bolt 7, which lock bolt is fastened to a stationary point of a door frame.

Still another feature of the invention resides broadly in the locking mechanism characterized by the fact that the mounting plate 2 is mounted in the frame of the door, and the lock bolts 7 are fastened to the door panels.

A further feature of the invention resides broadly in the locking mechanism characterized by the fact that the locking mechanism 1 is placed in the locked or unlocked position by an electric current pulse to one of the windings 31, 32 of the electromagnet 3.

Some examples of position responsive switches which may be utilized for the switch 4 are disclosed in U.S. Pat. No. 4,944,194; U.S. Pat. No. 4,980,622; U.S. Pat. No. 4,982,106; and U.S. Pat. No. 5,003,800, each of these U.S. patents being hereby expressly incorporated herein.

Some examples of Bowden type cables which may be used in conjunction with the present invention are to be found in U.S. Pat. No. 4,894,936; U.S. Pat. No. 4,907,676; U.S. Pat. No. 4,909,094; and U.S. Pat. No. 4,910,917, each of these U.S. patents being hereby expressly incorporated herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 195 01 420.0, filed on Feb. 19, 1995, and International Patent Application No. PCT/DE95/01140 having inventor Andreas Finke, and DE-OS 195 01 420.0 and DE-PS 195 01 420.0 filed and International Patent Application No. PCT/DE95/01140, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

1 Lock
2 Mounting plate
3 Electromagnet
4 Switch
5 Arm
6 Lock hook
7 Locking bolt
8 Fork head
9 Connection
10 Armature
11 Counterweight
12 Pivot
13 Arm
14 Arm
15 Lever
16 Permanent magnet
17 Permanent magnet
18 Hole
19 Hole
20 Center axis
21 Center axis
22 Directions of movement
23 Directions of movement
24 Cable
25 Opening
26 Locking hook
27 Locking hook
28 Lever
29 Arm
30 Arm
31 Winding
32 Winding
33 Spring element
34 Bowden cable
35 Direction of movement
36 Actuator bolt
37 Arm

What is claimed is:

1. A locking mechanism for a door, said door being at least one of a hydraulic, an electromechanical and a manually operated door, said locking mechanism being for the securing of two door members in at least one of a locked and an unlocked position, said locking mechanism comprising:

a locking lever member;

said locking lever member being movable between at least two lever positions;

said locking lever member substantially restraining relative movement between said two door members in a first of said at least two lever positions; and said locking lever member substantially permitting relative movement between said two door members in a second of said at least two lever positions;

an electromagnetic device to move said locking lever member between said first lever position and said second lever position;

a first permanent magnet disposed on said locking lever member;

said first permanent magnet moving with said locking lever member between said first lever position and said second lever position;

a second permanent magnet;

said second permanent magnet being stationarily mounted;

said first permanent magnet and said second permanent magnet exerting magnetic forces on one another to substantially maintain said locking lever member in at least one of said first and second lever positions;

said electromagnetic device comprising an electromagnet;

said electromagnet comprising first and second windings;

energization of said first winding of said electromagnet urging said locking lever member toward said first lever position; and energization of said second winding of said electromagnet urging said locking lever member toward said second lever position.

2. A locking mechanism for a door, said door being at least one of a hydraulic, an electromechanical and a manually operated door, said locking mechanism being for the securing of two door members in at least one of a locked and an unlocked position, said locking mechanism comprising:

a locking lever member;

said locking lever member being movable between at least two lever positions;

said locking lever member substantially restraining relative movement between said two door members in a first of said at least two lever positions;

said locking lever member substantially permitting relative movement between said two door members in a second of said at least two lever positions;

an electromagnetic device to move said locking lever member between said first lever position and said second lever position;

a first permanent magnet disposed on said locking lever member;

said first permanent magnet moving with said locking lever member between said first lever position and said second lever position;

a second permanent magnet;

said second permanent magnet being stationarily mounted;

said first permanent magnet and said second permanent magnet exerting magnetic forces on one another to substantially maintain said locking lever member in at least one of said first and second lever positions;

said electromagnetic device comprising an electromagnet;

energization of said electromagnet with a first current urging said locking lever member toward said first lever position; and energization of said electromagnet with a second current, said second current having an opposite polarity to said first current, urging said locking lever member toward said second lever position.

3. A locking mechanism for a door according to claim 1:

wherein said electromagnetic device additionally comprises an armature member connecting said electromagnet with said locking lever member;

wherein said locking lever member comprises at least two separate arm portions;

said first permanent magnet being mounted on a first of said at least two arm portions; and wherein said first and second permanent magnets are aligned with the same polarity disposed in opposition to one another.

4. A locking mechanism for a door according to claim 3:

wherein said electromagnetic device additionally comprises a forked member connecting said armature member with one of said at least two separate arm portions of said locking lever member.

5. A locking mechanism for a door according to claim 4:

wherein said locking mechanism additionally comprises a mounting plate member;

said locking lever member being pivotally mounted on said mounting plate member about a pivotal connection thereto; and said second permanent magnet being mounted on said mounting plate member.

6. A locking mechanism for a door according to claim 5:

wherein said locking mechanism additionally comprises indicator structure to indicate whether said locking lever member is disposed in at least one of said first lever position or said second lever position.

7. A locking mechanism for a door according to claim 6:

wherein said indicator structure comprises a switch device.

8. A locking mechanism for a door according to claim 7:

wherein said locking lever member comprises a locking hook portion.

9. A locking mechanism for a door according to claim 8:

wherein said locking mechanism additionally comprises apparatus to manually unlock to mechanically move said locking lever member into said second lever position without energization of said electromagnet.

10. A locking mechanism for a door according to claim 9:

wherein said locking mechanism additionally comprises first apparatus to move said locking lever member to said first lever position by energizing said first winding of said electromagnet with a current pulse; and wherein said locking mechanism additionally comprises second apparatus to move said locking lever member to said second lever position by energizing said second winding of said electromagnet with a current pulse.

11. A locking mechanism for a door according to claim 10:

wherein a first of said two door members comprises a first door panel member;

wherein said mounting plate member is mounted on said first door panel member;

wherein a second of said two door members comprises a second door panel member;

said second door panel member comprising a lock bolt member secured thereto; and wherein said locking lever member substantially restrains relative movement between said first and second door panel members by said locking hook portion of said locking lever member engaging said lock bolt member when said locking lever member is in said first lever position.

12. A locking mechanism for a door according to claim 10:

wherein a first of said two door members comprises a door panel member;

wherein said mounting plate member is mounted on said door panel member;

wherein a second of said two door members comprises a door frame member;

said door frame member comprising a lock bolt member secured thereto; and wherein said locking lever member substantially restrains relative movement between said door panel member and said door frame member by said locking hook portion of said locking lever member engaging said lock bolt member when said locking lever member is in said first lever position.

13. A locking mechanism for a door according to claim 10:

wherein a first of said two door members comprises a door frame member;

wherein said mounting plate member is mounted on said door frame member;

wherein a second of said two door members comprises a door panel member;

said door panel member comprising a lock bolt member secured thereto; and wherein said locking lever member substantially restrains relative movement between said door panel member and said door frame member by said locking hook portion of said locking lever member engaging said lock bolt member when said locking lever member is in said first lever position.

14. A locking mechanism for a door according to claim 10:

wherein said at least two arm portions of said locking lever member are counterbalanced by means of said pivotal connection of said locking lever member to said mounting plate member; and wherein said armature member of said electromagnet is connected to said locking lever member by at least one of a positive and a non-positive connection.

15. A locking mechanism for a door, said locking mechanism being for the securing of two door members in at least one of a locked and an unlocked position, said locking mechanism comprising:

a locking lever member;

said locking lever member being movable between at least two lever positions;

said locking lever substantially restraining relative movement between said two door members in a first of said at least two lever positions;

said locking lever substantially permitting relative movement between said two door members in a second of said at least two lever positions;

an electromagnetic device to move said locking lever member between said first lever position and said second lever position;

a first permanent magnet disposed on said locking lever member;

said first permanent magnet moving with said locking lever member between said first lever position and said second lever position;

a second permanent magnet;

said second permanent magnet being stationarily mounted;

said first permanent magnet and said second permanent magnet exerting magnetic forces on one another to substantially maintain said locking lever member in at least one of said first and second lever positions;

said electromagnetic device comprising an electromagnet;

said electromagnet comprising first and second windings;

energization of said first winding of said electromagnet urging said locking lever member toward said first lever position;

energization of said second winding of said electromagnet urging said locking lever member toward said second lever position;

said electromagnetic device additionally comprising an armature member connecting said electromagnet with said locking lever member;

said locking lever member comprising at least two separate arm portions;

said first permanent magnet being mounted on a first of said at least two arm portions; and said first and second permanent magnets being aligned with the same polarity disposed in opposition to one another.

16. A locking mechanism for a door according to claim 15:

wherein said electromagnetic device additionally comprises a forked member connecting said armature member with one of said at least two arm portions of said locking lever member.

17. A locking mechanism for a door according to claim 16:

wherein said locking mechanism additionally comprises a mounting plate member;

said locking lever member being pivotally mounted on said mounting plate member about a pivotal connection thereto; and said second permanent magnet being mounted on said mounting plate member.

18. A locking mechanism for a door according to claim 17:

wherein said locking mechanism additionally comprises indicator apparatus to indicate whether said locking lever member is disposed in at least one of said first lever position and said second lever position.

* * * * *

UNITED STATES PATENT AND TRADEMARK OFFICE

CERTIFICATE OF CORRECTION

PATENT NO. : 5,823,026

DATED : October 20, 1998

INVENTOR(S) : Andreas FINKE

It is certified that error appears in the above-identified patent and that said Letters Patent is hereby corrected as shown below:

On the title page, item [56], under the U.S. PATENT DOCUMENTS section, add the following:

| | | |
|---|---|---|
| --4,656,852 | 4/1987 | Deschamps |
| 3,751,088 | 8/1973 | Schlage et al. |
| 5,360,243 | 11/1994 | Hirsh |
| 4,439,808 | 3/1984 | Gillham |
| 4,858,452 | 8/1989 | Ibrahim |
| 4,854,619 | 8/1989 | Nakauchi |
| 4,850,623 | 7/1989 | Franklin et al.-- |

Signed and Sealed this

Seventeenth Day of August, 1999

*Attest:*

Q. TODD DICKINSON

*Attesting Officer*

*Acting Commissioner of Patents and Trademarks*